US008246492B2

(12) United States Patent
Gangelhoff

(10) Patent No.: US 8,246,492 B2
(45) Date of Patent: Aug. 21, 2012

(54) BASEBALL/SOFTBALL BATTING TEE

(76) Inventor: Joel T. Gangelhoff, Ocala, FL (US)

( * ) Notice: Subject to any disclaimer, the term of this patent is extended or adjusted under 35 U.S.C. 154(b) by 0 days.

(21) Appl. No.: 12/659,325

(22) Filed: Mar. 4, 2010

(65) Prior Publication Data

US 2011/0218058 A1 Sep. 8, 2011

(51) Int. Cl.
*A63B 69/00* (2006.01)

(52) U.S. Cl. ..... 473/417

(58) Field of Classification Search ..... 473/417, 473/422–424, 428, 429, 446, 457, 473, 474, 473/494, 454; D21/698, 715–720, 780
See application file for complete search history.

(56) References Cited

U.S. PATENT DOCUMENTS

| | | | | | |
|---|---|---|---|---|---|
| 2,976,041 | A | * | 3/1961 | White | 473/417 |
| 3,139,282 | A | | 6/1964 | Lande | |
| 3,883,138 | A | * | 5/1975 | Chorey | 473/417 |
| 4,092,023 | A | * | 5/1978 | Hazen | 473/454 |
| 4,647,042 | A | * | 3/1987 | Bruce | 473/430 |
| 4,709,924 | A | * | 12/1987 | Wilson et al. | 473/417 |
| 4,907,801 | A | * | 3/1990 | Kopp | 473/423 |
| 4,993,708 | A | * | 2/1991 | Prossor et al. | 473/417 |
| 5,002,274 | A | * | 3/1991 | Bidema | 473/417 |
| 5,004,234 | A | * | 4/1991 | Hollis | 473/417 |
| 5,100,134 | A | * | 3/1992 | Becker | 473/417 |
| 5,106,085 | A | * | 4/1992 | Lewy | 473/417 |
| 5,386,987 | A | | 2/1995 | Rodino, Jr. | |
| 5,427,369 | A | * | 6/1995 | Baquet, Jr. | 473/429 |
| 5,531,438 | A | * | 7/1996 | Corley | 473/429 |
| 5,582,403 | A | * | 12/1996 | George | 473/424 |
| 5,601,286 | A | * | 2/1997 | Fierbaugh | 473/429 |
| 5,611,539 | A | * | 3/1997 | Watterson et al. | 473/197 |
| 5,848,945 | A | * | 12/1998 | Miller et al. | 473/417 |
| 5,897,444 | A | * | 4/1999 | Hellyer | 473/417 |
| 5,916,045 | A | * | 6/1999 | Busch | 473/417 |
| 6,296,582 | B1 | * | 10/2001 | Minniear | 473/428 |
| 6,358,163 | B1 | * | 3/2002 | Tanner | 473/417 |
| 6,413,175 | B1 | * | 7/2002 | Mooney, Jr. | 473/417 |
| 6,663,513 | B2 | * | 12/2003 | Howard | 473/454 |
| 6,682,445 | B1 | * | 1/2004 | Tanner | 473/417 |
| 6,884,185 | B2 | * | 4/2005 | Udwin et al. | 473/417 |
| 6,893,363 | B1 | | 5/2005 | Chen et al. | |
| 7,063,632 | B2 | * | 6/2006 | Green | 473/417 |
| 7,186,193 | B1 | * | 3/2007 | McFadden, Jr. | 473/459 |
| 7,226,373 | B2 | * | 6/2007 | Arenas | 473/417 |
| 7,281,998 | B2 | | 10/2007 | Tanner | |
| 7,510,491 | B2 | | 3/2009 | Lortscher | |
| 7,727,089 | B2 | * | 6/2010 | Gilman | 473/445 |
| 7,736,246 | B2 | * | 6/2010 | Lortscher | 473/417 |
| D633,583 | S | * | 3/2011 | Guevara | D21/717 |
| 2008/0064534 | A1 | | 3/2008 | Lortscher | |
| 2009/0093325 | A1 | * | 4/2009 | Meltzer et al. | 473/454 |
| 2009/0163301 | A1 | | 6/2009 | Flading et al. | |

* cited by examiner

*Primary Examiner* — Mitra Aryanpour
(74) *Attorney, Agent, or Firm* — Jacobson Holman PLLC

(57) ABSTRACT

A baseball/softball batting tee has a base, and one or more support post and ball holding assemblies mounted in a substantially vertical orientation on the base. A primary support post and ball holding assembly has an adjustable height provided by an upper tube that is telescopically received within a lower tube and a ball supporting rod similarly telescopically received within the upper tube. Wiper seals and bushings are mounted in the upper ends of both tubes for sealing engagement with the respective telescopically received components, providing a friction fit sufficient to "lock" the relative positions of the tubes and rod to set the tee at a desired height while still allowing the tubes and the rod to be easily telescoped together. A secondary support post and ball holding assembly is also provided that can be readily interchanged with the primary.

20 Claims, 6 Drawing Sheets

BASEBALL/SOFTBALL BATTING TEE

BACKGROUND OF THE INVENTION

1. Field of the Invention

The present invention is related to the games of baseball and softball and, more particularly, to an improved batting tee for batting practice.

2. Description of the Related Art

Batting tees serve as tools for baseball and softball players of all ages to learn to hit the ball with greater proficiency and effectiveness. In order to be useful to players of different heights and also to allow the same player to learn to hit pitches at different heights, the height at which the tee supports the ball must be adjustable. It is also helpful if the tee is not easily knocked over or disrupted so as to avoid the need for repeated repositioning of the tee after every swing.

To achieve an adjustable height tee, various solutions have been reached using telescoping tubes, such as in U.S. Pat. No. 5,386,987 in which a rubber tube is inserted within the inner diameter of a metal tube and held therein by a friction fit. The rubber tube of this patent is not very durable, however, and, because the tops of the tubes are open, dirt and debris can enter the tubes.

To prevent the entry of material of various types into the interior of the tubes, U.S. Pat. No. 6,682,445 discloses a tee having two telescoping tubes in which the top of the upper tube is covered by a grommet and the joint between the two tubes is enclosed by an external support piece. The support piece does not provide a reliably tight fit, however, being representatively embodied as a protective tip taken from the leg of a piece of furniture and made to fit over a joint between the two tubes which must, of course, have different outer diameters in order to telescope. In addition, the frictional fit between the two tubes is also variable, being provided by an elongated split washer that is inserted within the lower tube. The washer is prevented from slipping down into the tube by a flange on the top of the washer while the support piece applies pressure to the flange, causing the washer to squeeze against the inner tube to create the frictional fit. The result is the potential for significant play between the tubes as well as increasingly degraded performance as the support piece is subjected to wear during use of the tee.

In an effort to solve the problem of the tee being repeatedly knocked over, U.S. Pat. No. 7,510,491 includes a housing at the base of the tee that contains extra balls. While the weight of the balls prevents the tee from tipping over easily, the structure is cumbersome. U.S. Pat. No. 6,893,363 discloses a tee having a flexible rubber tube coupled between the ball holder and the base of the tee to absorb shocks during batting. The tube is subject to considerable wear, however, particularly since its position near the ball holder makes it susceptible to being hit directly by an unskilled batter.

Accordingly, a need exists for an adjustable height tee that overcomes the foregoing problems in the prior art.

SUMMARY OF THE INVENTION

In view of the foregoing, one object of the present invention is to overcome the difficulties of adjusting the height of a baseball/softball tee easily and quickly and over a wide range.

Another object of the present invention is to provide a baseball/softball tee that allows a player to hit the ball off the tee safely while preventing the tee from being disrupted or knocked over.

A further object of the present invention is to provide a baseball/softball tee that allows for interchangeable support posts and accessories as well as quick and easy break down for portability.

Yet another object of the present invention is to provide a baseball/softball tee in accordance with the preceding objects in which the height of the tee is adjusted using two telescoping tubes that form a support post, and a rod that is telescopically received within the support post. Each tube has a urethane wiper seal and a bushing mounted therein that together maintain a particular telescoped relationship between the tubes and the rod to set the tee height, and also prevents sand and debris from entering the tubes.

A still further object of the present invention is to provide a baseball/softball tee in accordance with the preceding objects in which the support post is mounted to a base by an easy release, quick connect fastening mechanism that allows for support posts of different heights or styles, or for other accessories, to be alternately attached to and used with the base.

Yet still a further object of the present invention is to provide a baseball/softball tee in accordance with the preceding objects in which the base includes a weight stud for securing an Olympic style weight to the base to prevent disrupting, and including catapulting, of the tee when hit.

Another object of the present invention is to provide a baseball/softball tee in accordance with the preceding objects having a rubber ball cup which is supported on a nylon rod and specially molded to support the ball without interfering with the hitting of the ball by the batter.

In accordance with these and other objects, the present invention is directed to a baseball/softball batting tee having a generally square or rectangular base, a support post mounted in a substantially vertical orientation on the base, and a ball holding assembly including a rod with a ballcup coupled to an upper end of the support post. The support post includes an upper tube that is telescopically received within a lower tube. The rod is similarly telescopically received within the upper tube. The telescoping arrangement of the tubes and the rod enable the tee to be adjusted to any height between maximum and minimum values determined by the lengths of the tubes and the rod.

Urethane wiper seals are mounted in the upper end of the lower tube and in the upper end of the upper tube for sealing engagement with the outer surface of the upper tube and the outer surface of the rod, respectively. The wiper seals and bushings provide a friction fit sufficient to "lock" the relative positions of the tubes and the rod to set the tee at whatever height is chosen by the user, while still allowing the tubes and the rod to be easily telescoped together for portability when the tee is broken down. The seals also prevent sand and debris from entering the tubes.

The base of the tee includes an upwardly extending boss that is received within the lower end of the lower tube and secured therein by a quick release fastening mechanism. According to one preferred embodiment, the fastening mechanism includes a pin that extends transversely through horizontally aligned apertures formed in opposing sides of the lower tube to lock the post to the boss. The fastening mechanism allows the support post to be easily and quickly coupled and uncoupled from the base.

The present invention also preferably includes a weight stud formed on the base and offset to one side from the boss. The stud is sized to fit within the center hole of an Olympic style weight that, when mounted on the stud, effectively prevents the tee from being tipped over or catapulted if the player strikes the ballcup or rod when hitting the ball.

The present invention also preferably includes more than one support post and ball holding assembly in order to provide a wide range of different ball heights. According to one alternate embodiment, a secondary support post and ball holding assembly has a fixed height and may be interchangeably coupled to and used with the same base as already summarized.

The foregoing objects and other advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
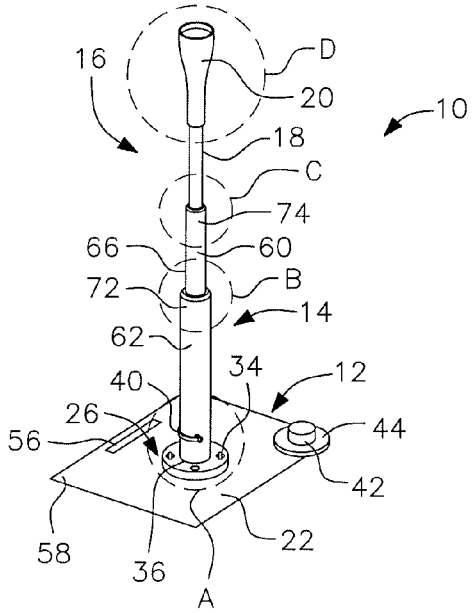
FIG. 1 shows a perspective view of an adjustable tee in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As shown in FIG. 1, the present invention is directed to a baseball/softball batting tee generally designated by reference numeral 10. The tee 10 includes a generally square or rectangular base, generally designated by reference numeral 12, an adjustable support post mountable in a substantially vertical orientation on the base, generally designated by reference numeral 14, and a ball holding assembly in substantial vertical alignment with the support post, generally designated by reference numeral 16. The ball holding assembly 16 includes a rod 18 with a ballcup 20 mounted to an upper end thereof.

Figure 2:
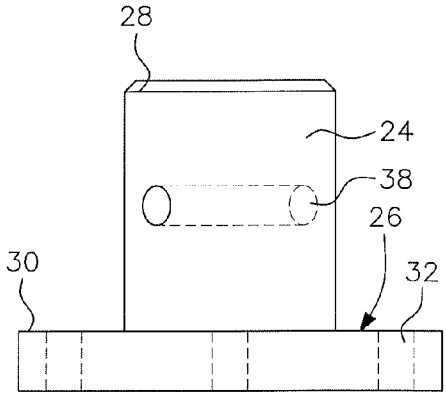
FIG. 2 is a side view of the flanged mounting disc shown in FIGS. 1 and 1A.
Figure 3:
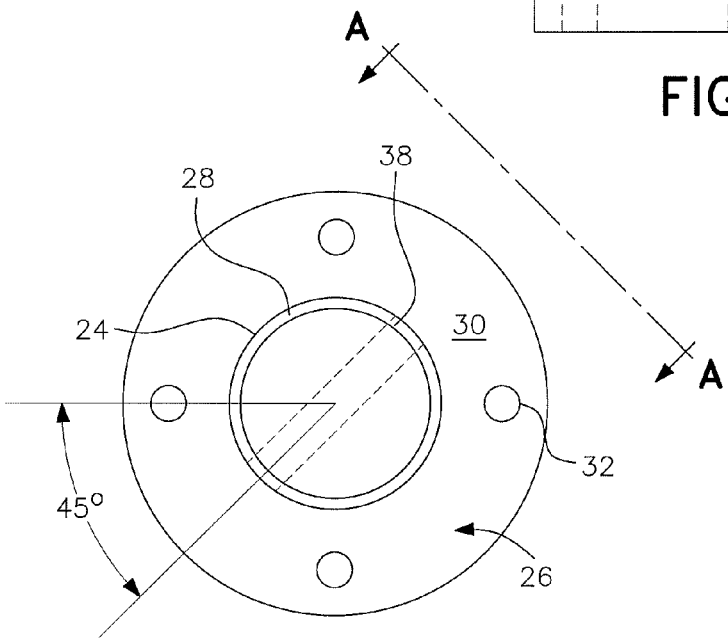
FIG. 3 is a top view of the flanged mounting disc shown in FIG. 2.
Figure 4:
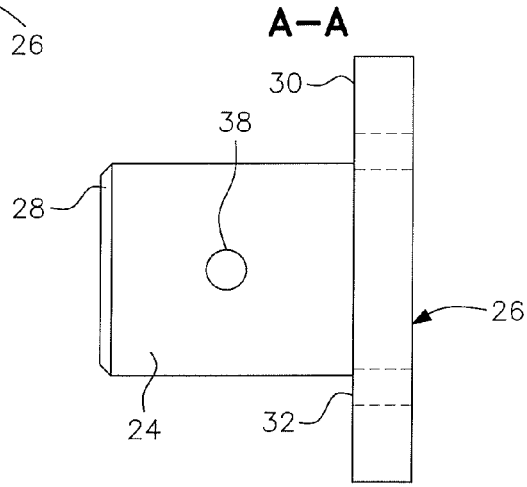
FIG. 4 is another side view of the flanged mounting disc taken along line A-A of FIG. 3.

The base 12 includes a generally horizontal plate 22 and an upwardly extending boss 24, shown in FIGS. 2-4, that is preferably positioned in about the center of the plate 22. The boss is preferably cylindrical and is supported on a flanged mounting disc generally designated by reference numeral 26. The boss 24 is preferably about 1.5 inches tall, with the combined height of the mounting disc 26 and the boss 24 being on the order of about 1.87 inches. The diameter of the boss is on the order of about 1.248 inches, and the upper edge 28 of the boss is preferably chamfered to facilitate attachment of the support post 14.

The mounting disc 26 includes a generally cylindrical flange 30. A plurality of apertures 32 are drilled through the flange for receiving fastening elements 34 that, in turn, are received in corresponding holes in the base plate (not shown) to secure the boss 24 to the base plate 22. The apertures 32 in the flange 30 are spaced outwardly from the boss 24 at a sufficient distance so that, when the support post 14 is mounted to the base 12, the annular outer edge 36 of the lower end of the support post 14 comes into direct abutment with the top of the flange 30 and inside a perimeter defined by the fastening elements 34. According to the preferred embodiment shown, there are four flange apertures 32 evenly spaced from one another around the boss 24, although a greater or fewer number of apertures and corresponding fastening elements could be used.

The boss 24 has a radial bore 38 formed therethrough that is substantially transverse to the height of the boss for receiving a fastening mechanism 40. When the lower end of the support post 14 is fitted over the boss 24 and the bottom edge 36 of the post 14 is in abutment with the top of the flange 30, the post 14 is then secured to the base boss 24 by the fastening mechanism 40 as will be described hereinafter. The bore 38 is preferably offset equally between each pair of fastening elements 34 by an angle of approximately 45°.

Figure 5:
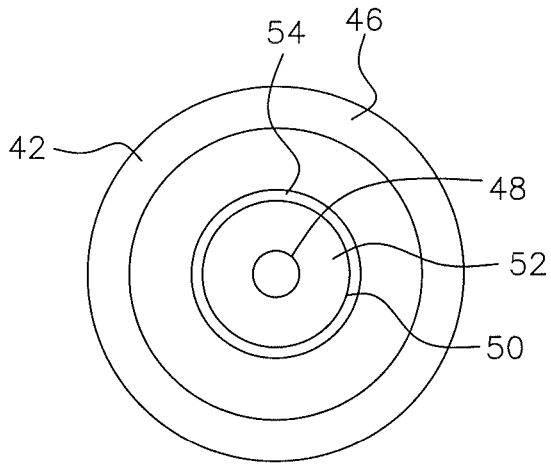
FIG. 5 is a top view of the weight stud of the tee shown in FIG. 1.
Figure 6:
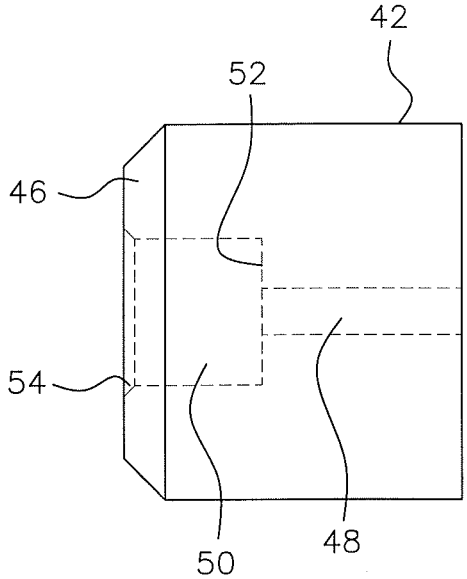
FIG. 6 is a side view of the weight stud shown in FIG. 5.

The base 12 preferably further includes a weight stud 42 positioned to one side of the boss. The weight stud 42, as shown in FIGS. 5 and 6, is generally circular in top view and has an outer diameter of about 2.00 inches that is sized to fit within a center hole of an Olympic style weight ring. The stud 42 is about 1.75 inches tall and the upper edge 46 of the stud is preferably chamfered to facilitate placement of the weight ring 44 thereon.

To secure the weight stud 42 to the base plate 22, an axial bore 48 having a first diameter is drilled through the center of the stud from top to bottom. A further blind bore 50 having a second diameter greater than the first diameter of the axial bore is drilled only partly through the top portion of the stud, to a depth of about 0.75 inches, to create a ledge 52. The stud is secured to the base plate using a fastening element (not shown) that, while extending through the axial bore 48 and a corresponding hole (not shown) in the base plate 22, has a head that can be tightened against the ledge 52. The second diameter of the blind bore 50 is sufficiently large, on the order of about 0.75 inches, to accommodate a socket or other tool used to tighten the fastening element. The upper edge 54 of the blind bore 50 is also preferably chamfered.

While not necessary to the effectiveness of the tee according to the present invention, the base plate preferably includes a cutout 56 as shown in FIG. 1. While the cutout 56 may be of various shapes, one preferred shape is an elongated opening with rounded ends and chamfered edges that provides a comfortable hand grip for carrying the base plate.

Prior to use of the tee, the weight ring 44, which can be of different weights while having the same center hole opening, is placed down over the stud 42. A ten pound Olympic style weight ring is preferred. With the corner of the base plate having the stud being farthest from the pitcher, and the opposite diagonal corner 58 being nearest the pitcher, the weight ring provides sufficient ballast to the tee to eliminate catapulting or other movement of the tee even if the support post or ball holding assembly is hit when the player swings at the ball. After use, the weight may be easily removed so that the tee is easy to handle and carry.

Figure 7:
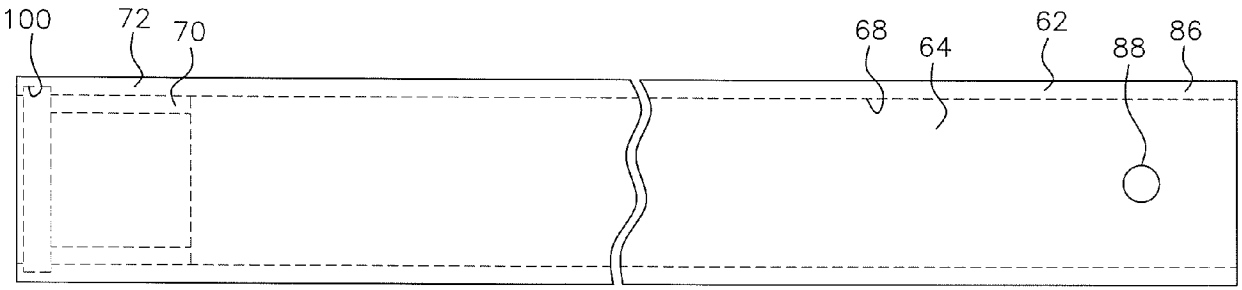
FIG. 7 is a side view of the lower tube of the tee shown in FIG. 1.

The support post 14 includes an upper tube 60 and a lower tube 62, both of which are preferably made of aluminum which is strong and yet lightweight. As shown in FIG. 7, the lower tube 62 has a hollow center 64 into which the upper tube 60 is received in a telescoping manner. According to a preferred embodiment, the lower tube 62 has an outer diameter of about 1.50 inches, an inner diameter of about 1.25 inches, and a length of about 16.00 inches. The upper tube 60 has an outer diameter of about 1.0 inches, an inner diameter of about 0.75 inches, and a length of about 16.00 inches.

To provide a snug fit between the outer surface 66 of the upper tube 60 and the inner surface 68 of the lower tube 62, a bushing 70 is press-fit into the upper end 72 of the lower tube 62. The bushing 70 may be embodied as a 1 inch Delron bushing having an inner diameter of 1.0 inches in order to fit closely with the outer surface 66 of the upper tube 60 and a press-fit of 0.003 inch into the inner diameter of tube 62.

Figure 8:
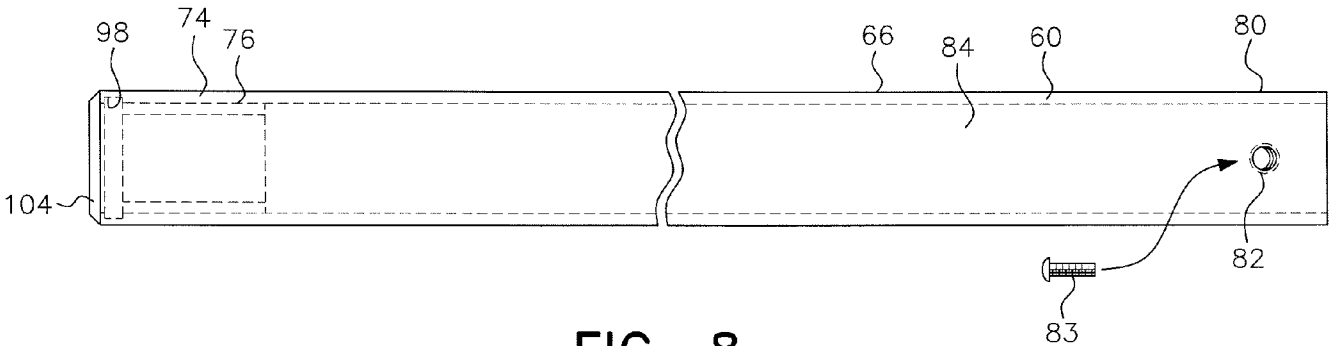
FIG. 8 is a side view of the upper tube of the tee shown in FIG. 1.

Similarly, as shown in FIG. 8, the upper end 74 of the upper tube 60 is also fitted with a bushing 76 having an inner diameter of about 0.625 inches to fit snugly against the outer surface 78 (see FIG. 9) of the rod 18 of the ball holding assembly 16, as will be discussed further hereinafter. The lower end 80 of the upper tube 60 has an aperture 82 formed in one side that receives a transversely extending element that serves to at least partially bisect the hollow interior 84 of the upper tube 60 as will be discussed further hereinafter. According to one preferred embodiment, the aperture 82 is a tapped hole and the transversely extending element is a threaded fastener 83 that is secured within the aperture.

Figure 1A:
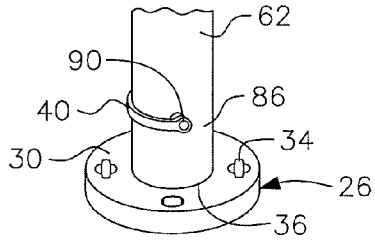
FIG. 1A is an enlarged view of section A of the tee as identified in FIG. 1.

The lower end 86 of the lower tube 62 fits over and is secured to the base boss 24 by the fastening mechanism 40 to mount the support post 14 to the base 12 for use of the tee 10. According to one preferred embodiment, the lower end 86 of the tube 62 has horizontally aligned apertures 88 formed in opposing sides thereof. The fastening mechanism 40 includes a pin 90 (see FIG. 1A) that extends transversely through the apertures 88 in the lower tube 62 and through the radial bore 38 in the boss 24. Once in place, the pin 90 is locked in place and prevents the post from being pulled upwardly off the boss. The pin 90 is preferably embodied as a non-threaded fastener such as a clevis pin, a quick release pin, a T-handle ball lock pin, or the like, as would be understood by persons of ordinary skill in the art.

Figure 1B:
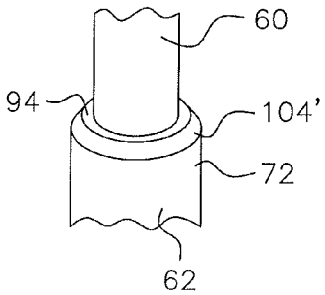
FIG. 1B is an enlarged view of section B of the tee as identified in FIG. 1.
Figure 1C:
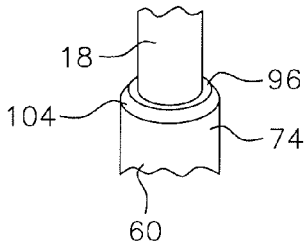
FIG. 1C is an enlarged view of section C of the tee as identified in FIG. 1.

As shown in the detail of FIG. 1B, the upper end 72 of the lower tube 62 includes a urethane wiper seal 94 mounted therein for sealing engagement with the outer surface 66 of the upper tube 60. Similarly, as shown in the detail of FIG. 1C, the upper end 74 of the upper tube 60 has a urethane wiper seal 96 mounted therein for sealing engagement with the rod 18 of the ball holding assembly 16. Each of the tubes 60, 62 is machined out to form a respective groove 98, 100 on an inner surface of the respective tube 60, 62 into which the respective ring seal 94, 96 is snap-fit.

Figure 10A:
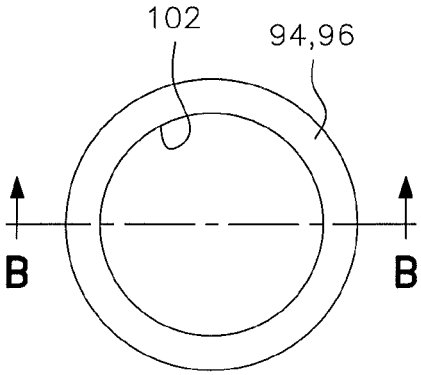
FIG. 10A is a top view of a ring seal used in the tee of FIG. 1 and shown in different sizes in each of FIGS. 1B and 1C.
Figure 10B:
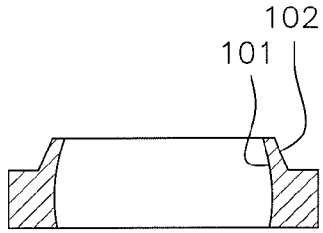
FIG. 10B is a cross-sectional view taken along line B-B of FIG. 10A.

As representatively shown in FIGS. 10A and 10B, the ring seals 94, 96 are preferably molded from 90A durometer urethane which is flexible enough to easily snap into the grooves while yet having the durability needed to withstand the frictional stresses caused by repeated movement of the rings over the respective outer surfaces of the upper tube and the rod as the tee height is adjusted. Through friction against the outer surfaces of the upper tube and rod, the urethane wiper seals maintain a chosen tee height which is set by the insertion depth of the upper tube within the lower tube and of the rod within the upper tube.

Urethane ring seals appropriate for use with the present invention include the Style ST Urethane Wiper Rings manufactured by Hercules Bulldog Sealing Products of Clearwater, Fla. As shown in FIG. 10A, such rings are annular with a concave inner surface 101 and an inwardly directed rim 102 that wipes the outer surface 66, 78 of the upper tube 60 and rod 18, respectively, when the tee height is adjusted. The ring seals may be manufactured to have any one of a wide range of sizes. Whatever the size, each seal has a defined inner rod diameter "A", an outer diameter "B", and a base thickness "C" as shown in FIG. 10B. A preferred size for the upper tube wiper seal 96 in the present embodiment has a rod diameter "A" of ⅝th inch, an outer diameter "B" of ⅞th inch, and a base thickness of ⅛th inch. A preferred size for the lower tube wiper seal 94 has a rod diameter "A" of 1 inch, an outer diameter "B" of 1-⅜th inch, and a base thickness of 3/16th inch. As would be understood by skilled persons, these sizes are based upon the diameters of the tubes used to make the tee.

While the tee 10 is portable even when fully assembled, the tee can be broken down for enhanced portability. Depending upon the relative lengths of the tubes, the upper tube 60 may be fully received within the lower tube 62 when the tubes are telescoped together. To facilitate unimpeded extension of the upper tube 60 back out of the lower tube 62 when the tee is being lengthened for use, the upper edge 104 of the upper tube 60 is chamfered as shown in FIGS. 1C and 8. The chamfered upper edge 104 allows the upper end 74 of the upper tube 60 to move past the ring seal 94 in the top 72 of the lower tube 62 without catching, after which the outer surface 66 of the upper tube 60 is brought into frictional engagement with the ring seal 96 for setting of the tee height. The upper edge 104' of the lower tube 62 may also be chamfered as shown in FIG. 1B.

The rod 18 of the ball holding assembly 16 is telescopically received within the hollow interior 84 of the upper tube 60 when the tee 10 is compacted, and extends upwardly therefrom in use. The rod 18 is preferably made of black nylon which provides the needed stiffness to support the ball while, at the same time, offering a degree of flexibility for reducing impact stress transferred to the batter when the batter hits the ball holding assembly while swinging. In one preferred embodiment, the rod has a length of about 19.00 inches.

Figure 9:
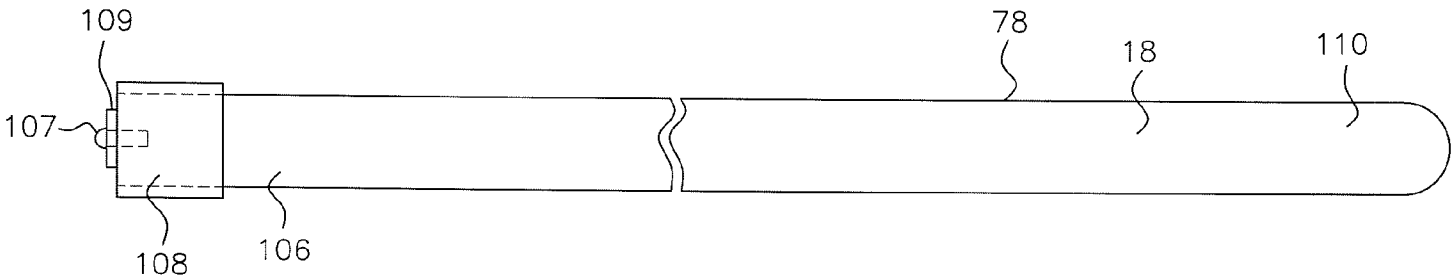
FIG. 9 is a side view of the rod of the tee shown in FIG. 1.

As shown in FIG. 9, the outer diameter of the rod 18 is about 0.625 inches to fit snugly against the bushing 76 and wiper seal 96 in the upper end 74 of the upper tube 60. A first or lower end 106 of the rod that is received within the upper tube has a bushing or cap 108 affixed thereto, such as by friction-fit, gluing, using a threaded fastener 107 and washer 109, or the like. The cap 108 prevents the rod from 18 being completely pulled out of the upper end 74 of the upper tube 60 when the tee 10 is lengthened. The cap 108 also acts as a stop against the transversely extending fastener 83 in the lower end 80 of the upper tube 60. In having a greater width than that of the rod 18, the cap 108 cannot pass the transversely extending fastener 83 and therefore ensures that the rod 18 cannot fall out of the lower end 80 of the upper tube 60 when the upper tube is fully telescoped into the lower tube 62. The second end 110 of the rod opposite the first end 106 is coupled to the ballcup 20.

Figure 1D:
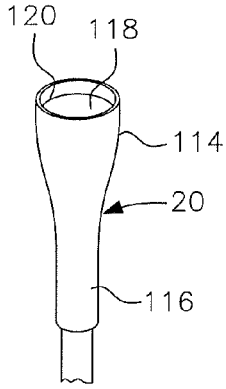
FIG. 1D is an enlarged view of section D as identified in FIG. 1.

As shown in FIG. 1D, the ballcup 20 is formed of a truncated cone-shaped tubular member having a wide end 114 and a narrow end 116. The narrow end 116 is fitted onto the second or upper end 110 of the rod 18 with a friction fit and/or glued or otherwise secured, while the wide end 114 is molded to have an inwardly tapering mouth 118 with a chamfered edge 120 that provides a secure rest for a baseball or softball. The ballcup 20 is preferably made of rubber or other material having a greater elasticity and flexibility than that of the black nylon of the rod. The greater elasticity and flexibility ensures that the batter can hit the ballcup safely and comfortably when swinging at the ball.

According to the present invention, support posts of different height ranges may be easily used on the same base. Shorter secondary tees are needed for younger batters or when a batter needs to learn to hit low pitches. Conversely, tall batters or batters wanting to practice hitting high pitches can benefit from the use of a taller tee. Through the quick-release fastening mechanism, the support post of one tee may be easily and quickly replaced with another support post and tee at any time to accommodate all batting needs.

According to one preferred embodiment, the support post and ball holding assembly described thus far is adjustable between a height of about 26 inches to about 53 inches. Another preferred embodiment has a support post and ball holding assembly that is adjustable between about 22 inches and about 41 inches, such as for girls or younger players of either sex. By changing the lengths of the upper and lower tubes and of the ball holding assembly, a tee may be made to have a different range of height adjustment as would be understood by skilled persons from the foregoing description.

Figure 11:
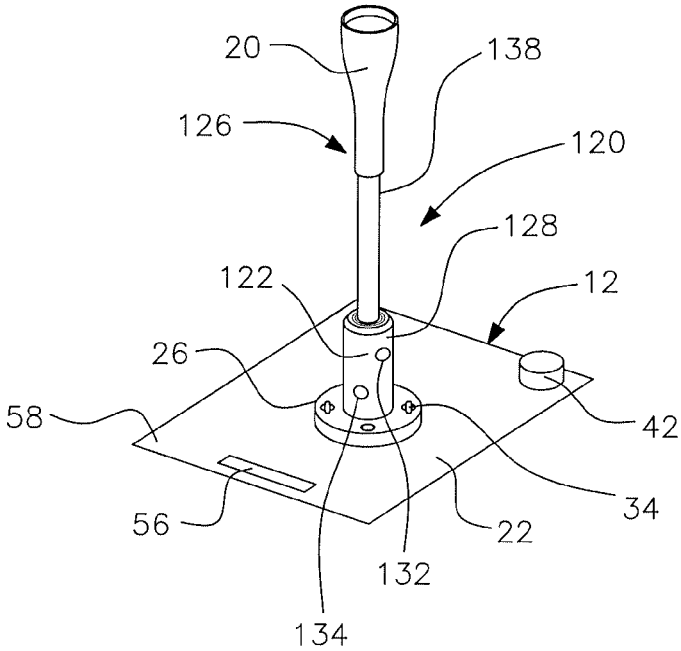
FIG. 11 is a perspective view of a secondary low ball tee in accordance with the present invention.

An alternately designed secondary support post and ball holding assembly configured to form a low ball tee is shown in FIG. 11 and generally designated by reference numeral 120. The secondary low ball tee 120 preferably has a fixed height, being constructed of a single support post tube 122 to which the ball holding assembly, generally designated by reference numeral 126, is fixedly connected. According to one preferred embodiment, the fixed height is about 16 inches although, of course, other height selections may be obtained with appropriately lengths of the tubing and ball holding assembly.

Figure 12:
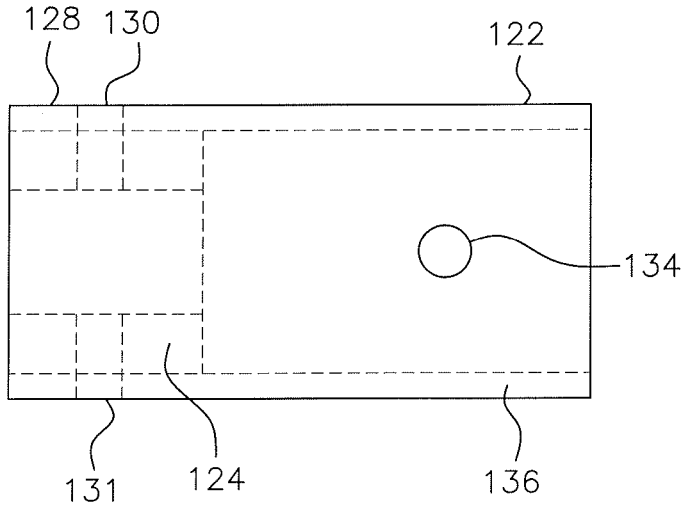
FIG. 12 is a side view of the tube of the low ball tee shown in FIG. 11.

More particularly, as shown in FIG. 12, the tube 122 has the same inner and outer diameter as the lower tube 62 described above in connection with the primary adjustable height tee, and is also preferably made of aluminum. Accordingly to one preferred embodiment, the tube 122 has a length of about 3.00 inches. A bushing 124 is press-fit into the upper end 128 of the tube which may be embodied as a Delron bushing having an outer diameter of about 1.250 inches and an inner diameter of about 0.625 inches with a press-fit of 0.003 inch into the inner diameter of tube 122. Aligned holes 130, 131 are drilled through opposing sides of the upper end 128 of the tube 122 and bushing 124 to receive a fastening element 132 that extends transversely to the tube length. As in the first embodiment, a further hole 134 is also drilled through opposing sides of the tube 122 at its lower end 136 to receive the fastening mechanism 40 used to secure the low ball tee 120 to the base 12. This hole 134 is preferably about 0.750 inches from the bottom edge of the tube 122, or whatever distance matches that at which the hole 88 is drilled in the primary support post. The fastening mechanism 40 and its manner of connecting the support post tube 122 to the boss 24 on the base plate 22 is the same as in the first embodiment.

Figure 13:
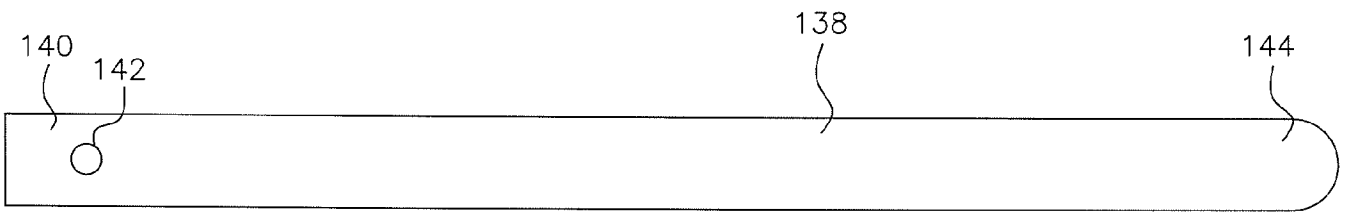
FIG. 13 is a side view of the rod of the low ball tee shown in FIG. 11.

The ball holding assembly 126 of the low ball tee 120 is constructed similarly to that already described in connection with the primary tee, being made of a black nylon rod 138, shown in FIG. 13, onto which another ballcup 20 is pressed or glued or otherwise secured. The outer diameter of the rod is about 0.625 to fit snugly inside the bushing 124 and according to one preferred embodiment has a length of about 9.00 inches. As shown in FIG. 13, and unlike the primary tee, the end 140 of the rod 138 that is received within the tube 122 does not have a cap thereon but is drilled to form a transverse hole 142. Once the rod 138 is positioned within the bushing 124, a fastening element 132 is inserted through the holes 130, 131 in the opposing sides of the tube 122 and bushing 124, and through the transverse hole 142 in the rod 138, to secure the bushing and the rod against the walls of the tube 122. The opposite end 144 of the rod 138 is secured within the ballcup 20 as in the primary tee.

By varying the length of the tube 122 and/or of the ball holding assembly 126, the secondary low ball tee 120 can be made to have any of a number of heights as would be understood by persons of ordinary skill in light of this description.

As described herein, the tee according to the present invention provides for a highly durable, adjustable primary tee that is easy to set up and very stable while in use. The telescoping arrangement of the tubes and the rod enable the primary tee to be adjusted to any height between maximum and minimum values determined by the lengths of the tubes and the rod, while the bushings and urethane wiper seals provide both excellent holding power to secure the chosen height of the tee and good protection against abrasive elements entering the tubes and causing unwanted wear. While affording a strong frictional hold, the seals nonetheless allow the tubes and the rod to be easily telescoped together for portability when the tee is broken down.

In addition, the quick-connect and release coupling mechanism between the support post and the base of the tee through the upwardly extending boss and non-threaded fastener allows for quick interchange of tees of different heights and secure mounting of whatever tee is in use. In addition, the weight stud on the base plate of the tee provides an easy means of using any Olympic style weight (preferably 10 pounds) to provide a counterbalance against forces that would otherwise act to tip the tee over or cause it to catapult when struck by a batter. When the tee is not in use, the weight is easily removed and does not encumber the portability of the tee for the user.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A baseball/softball batting tee comprising:

a base;

a height adjustable support post mounted in a substantially vertical orientation on the base, said support post including an upper tube and a lower tube, a circumferential groove formed in an inner surface of the upper end of the lower tube, said upper tube being received within said lower tube in a telescoping relationship for height adjustment, a lower end of said lower tube being secured to said base and a wiper seal formed as a flexible ring that is snap-fit into said groove formed in the upper end of the lower tube for sealing engagement with said upper tube, said wiper seal maintaining frictional engagement against the outer surface of the upper tube during height adjustment of said support post using said tube telescoping relationship and, when a desired height is obtained, said frictional engagement of said wiper seal maintaining a chosen support post height set by an insertion depth of the upper tube within the lower tube; and a rod with a ball-cup mounted to an upper end thereof, said rod being telescopically received within said support post.

2. The baseball/softball batting tee of claim 1, wherein said wiper seal is made of urethane and said upper tube includes a further urethane wiper seal for sealing engagement with an outer surface of said rod, said further wiper seal being a flexible ring that is snap-fit into a circumferential groove formed in the upper end of the upper tube, said further wiper seal maintaining frictional engagement against the outer surface of the rod during height adjustment of said rod using said telescoping relationship with said support post and, when a desired height is obtained, said frictional engagement being sufficient to secure the relative positions of the rod and the support post to maintain the tee at the desired height.

3. The baseball/softball batting tee of claim 1, wherein said base includes an upwardly extending boss that is received within the lower end of the lower tube and secured therein by a fastening mechanism.

4. The baseball/softball batting tee of claim 3, wherein opposing sides of the lower end of the lower tube each have an aperture therethrough, said apertures being horizontally aligned with one another, said fastening mechanism including a pin that extends transversely to said support post to pass through both apertures to lock the post to the upwardly extending boss.

5. The baseball/softball batting tee of claim 3, wherein said boss is substantially centered on said base, said base further including a stud positioned to one side of the boss, said stud sized to fit within a center hole of a weighted ring.

6. The baseball/softball batting tee of claim 3, wherein the fastening mechanism is configured to allow the support post to be easily coupled to and uncoupled from the base and also replaced with another support post.

7. The baseball/softball batting tee of claim 6, wherein said tee includes a plurality of support posts of different heights or height ranges, each support post being adapted to be interchangeably mounted to said base.

8. The baseball/softball batting tee of claim 7, wherein said plurality of support posts includes a tall post having an adjustable height range of from about 26 inches to about 53 inches, and a shorter post having an adjustable height range of from about 22 inches to about 41 inches.

9. A baseball/softball batting tee comprising:

a base including a base plate and a base mounting element;

a support post mounted in a substantially vertical orientation on the mounting element of said base, said support post including an upper tube and a lower tube, said upper tube being received within said lower tube in a telescoping relationship, a lower end of said lower tube being secured to said base mounting element and a circumferential groove formed in an inner surface of said lower tube's upper end, a wiper seal formed as a flexible ring being snap-fit into said groove for sealing engagement with an outer surface of said upper tube, said wiper seal maintaining frictional engagement against the outer surface of the upper tube during adjustment of a height of said support post using said tube telescoping relationship and, when a desired height is obtained, said frictional engagement being sufficient to secure the relative positions of the tubes to maintain the tee at the desired height;

a quick release fastening mechanism for securing the support post to the base mounting element, said quick release fastening mechanism allowing for easy replacement of the support post with an alternate support post;

a ball holding assembly mounted to an upper end of said support post;

a weight stud mounted on said base plate, said weight stud sized to fit within a center hole of a weighted ring; and said base mounting element of said base including a flanged disc having an upwardly extending boss thereon that is received within the lower end of the support post, said support post being secured to said boss by said quick release fastening mechanism, an outer edge of said support post lower end being in abutment with an upper surface of said flanged disc when the support post is secured.

10. The batting tee as set forth in claim 9, wherein said ball holding assembly includes a rod with a ball-cup mounted to an upper end thereof, said rod being telescopically received within said upper tube of said support post.

11. The batting tee as set forth in claim 10, wherein an upper end of said upper tube includes a further circumferential groove formed in an inner surface of said upper tube's upper end and a further wiper seal formed as a flexible ring that is snap-fit into said further circumferential groove for sealing engagement with an outer surface of said rod.

12. The batting tee as set forth in claim 9, wherein opposing sides of the lower end of the support post each have an aperture therethrough, said apertures being horizontally aligned with one another, said fastening mechanism including a pin that extends transversely to said support post to pass through both apertures to lock the post to the boss.

13. The batting tee as set forth in claim 9, further comprising a bushing press-fit into said lower tube's upper end and inwardly past said groove to provide a snug fit between the outer surface of the upper tube and the inner surface of the lower tube.

14. The batting tee as set forth in claim 13, wherein said upper tube includes a further bushing fitted in the upper tube and past said further groove to provide a snug fit between an inner surface of said upper tube and an outer surface of said rod.

15. A baseball/softball batting tee assembly comprising:

a base plate;

an upwardly extending boss secured to said base plate, said boss having a radial bore formed therethrough that is substantially transverse to a height of said boss;

a primary tee having an adjustable support post and ball holding assembly with telescoping members to allow a user to variably adjust a height of the tee over a height range dependent on a relationship between the telescoping members, said adjustable support post being configured to be mounted over said boss;

a secondary tee having a fixed height support post and a fixed height ball holding assembly, said secondary tee support post being configured to be mounted over said boss;

said adjustable support post including an upper tube and a lower tube, said upper tube being received within said lower tube in a telescoping relationship, a lower end of said lower tube being secured to said boss, and a wiper seal formed as a flexible ring that is snap-fit into a circumferential groove formed in an inner surface of said lower tube's upper end for sealing engagement with an outer surface of said upper tube, said wiper seal maintaining frictional engagement against the outer surface of the upper tube during adjustment of a height of said adjustable support post using said tube telescoping relationship and, when a desired height is set, said frictional engagement being sufficient to secure the relative positions of the tubes to maintain the primary tee at the desired height; and a quick connect/release fastening mechanism for interchangeably securing the primary and secondary tees at alternate times to the boss on the base plate, said fastening mechanism including a pin that extends transversely to each of said adjustable support post and said fixed height support post and passes through apertures formed in opposing sides of each of said adjustable support post and said fixed height support post and through said boss radial bore to lock either of said posts to the boss.

16. The batting tee assembly as set forth in claim 15, wherein said ball holding assembly includes a rod with a ball-cup mounted to an upper end thereof, said rod being telescopically received within said upper tube of said support post.

17. The batting tee assembly as set forth in claim 16, wherein an upper end of said upper tube includes a further circumferential groove formed in an inner surface of said upper tube's upper end and a further wiper seal formed as a flexible ring snap-fit into said further groove for sealing engagement with an outer surface of said rod.

18. The batting tee assembly as set forth in claim 17, further comprising a bushing press-fit into said lower tube's upper end and inwardly past said groove to provide a snug fit between the outer surface of the upper tube and the inner surface of the lower tube.

19. The batting tee assembly as set forth in claim 18, wherein said upper tube includes a further bushing fitted in the upper tube and past said further groove to provide a snug fit between an inner surface of said upper tube and an outer surface of said rod.

20. The batting tee assembly as set forth in claim 19, wherein said wiper seals are made of urethane.

* * * * *